US007226330B2

(12) United States Patent
Gilmer

(10) Patent No.: US 7,226,330 B2
(45) Date of Patent: Jun. 5, 2007

(54) FLOTATION SWIMSUIT AND METHOD FOR CONSTRUCTION THEREOF

(75) Inventor: Patti C. Gilmer, Lula, GA (US)

(73) Assignee: Future Products Corporation, Gainesville, GA (US)

( * ) Notice: Subject to any disclaimer, the term of this patent is extended or adjusted under 35 U.S.C. 154(b) by 25 days.

(21) Appl. No.: 11/251,065

(22) Filed: Oct. 14, 2005

(65) Prior Publication Data

US 2006/0094316 A1 May 4, 2006

Related U.S. Application Data

(63) Continuation of application No. 09/708,309, filed on Nov. 7, 2000, now Pat. No. 6,971,935.

(60) Provisional application No. 60/164,305, filed on Nov. 8, 1999.

(51) Int. Cl.
*B63C 9/08* (2006.01)

(52) U.S. Cl. ..... 441/106

(58) Field of Classification Search ..... 441/102, 441/106, 108, 114, 115, 117, 119, 116
See application file for complete search history.

(56) References Cited

U.S. PATENT DOCUMENTS 2,629,118 A * 2/1953 Frieder et al. ..... 441/110
3,540,067 A 11/1970 Deruaz
4,291,427 A * 9/1981 Rhea ..... 441/120
5,459,874 A * 10/1995 Meredith ..... 2/67
5,823,838 A * 10/1998 Darcy et al. ..... 441/106
6,235,661 B1 * 5/2001 Khanamirian ..... 442/223

FOREIGN PATENT DOCUMENTS

WO WO01/42081 A1 6/2001

OTHER PUBLICATIONS

Patent Cooperation Treaty International Search Report for PCT Application No. PCT/US2000/41991 dated May 14, 2001.
Patent Cooperation Treaty International Preliminary Examination Report for PCT Application No. PCT/US2000/41991 dated Nov. 18, 2003.

* cited by examiner

*Primary Examiner*—Jesús D. Sotelo
(74) *Attorney, Agent, or Firm*—Troutman Sanders LLP; Gerald R. Boss; James Hunt Yancey, Jr.

(57) ABSTRACT

A flotation swimsuit is provided for providing strategically distributed buoyancy to a wearer. The flotation swimsuit includes a form-fitting torso covering having a retaining pocket for enclosing a unitary flotation element. The unitary flotation element includes a backsheet formed from buoyant material having a thickness within a first predetermined range for providing general buoyancy to a wearer, an inner surface for presentation toward the wearer, and an outer surface for presentation away from the wearer. The unitary flotation element also includes a plurality of enhanced buoyancy regions integrally carried by the backsheet for providing enhanced buoyancy to specific areas of the wearer's body. The enhanced buoyancy regions can be formed with a buoyant material having a thickness greater than the backsheet. Each enhanced buoyancy region extends outwardly from the outer surface of the backsheet. Other embodiments are also claimed and described.

19 Claims, 11 Drawing Sheets

FLOTATION SWIMSUIT AND METHOD FOR CONSTRUCTION THEREOF

CROSS-REFERENCE TO RELATED APPLICATIONS

This patent application is a continuation of U.S. patent application Ser. No. 09/708,309 having a filing date of 7 Nov. 2000, now U.S. Pat. No. 6,971,935, which claims priority to and the benefit of U.S. Provisional Patent Application No. 60/164,305 having a filing date of 8 Nov. 1999. Each of the above-listed patent applications are hereby incorporated by reference as if fully set forth below in their entirety.

TECHNICAL FIELD

This invention relates generally to articles of apparel for water sports and the like, and more particularly to swimsuits for providing flotation to the wearer and specific means of construction of such swimsuits.

BACKGROUND

Swimming and boating are popular recreational activities which are enjoyed by people of all ages, especially children. In the interest of safety during these activities, it is important that individuals learn to swim as early as possible. However, it is usually necessary for non-swimmers to enter the water for significant periods of time while they are learning to swim, thereby placing them at risk for drowning. Therefore, it is desirable to provide non-swimmers, especially children, with flotation devices for use while they are in the water and when they are learning to swim. In fact, most states require that children wear personal flotation devices while on boats.

One simple type of personal flotation device that has been found to be especially well adapted for use by children and non-swimmers is the flotation swimsuit. Flotation swimsuits are generally less obtrusive than standard personal flotation devices, such as life jackets. Thus, the wearer of a flotation swimsuit feels more natural, allowing the wearer to learn to swim without feeling overly dependent upon a flotation device. Additionally, flotation swimsuits may enhance the safety of children since it is more difficult for a child to remove a flotation swimsuit than it is to remove a vest or other similar flotation device.

Flotation swimsuits have been developed in a variety of designs. However, each of these suffers from disadvantages. For example, many flotation swimsuits rely upon inflatable compartments to provide buoyancy. However, inflatable compartments usually require inflation immediately prior to use and may become ineffective if punctured, thereby placing a child at risk for drowning. Other flotation swimsuits rely upon blocks of closed cell foam or like materials to provide buoyancy. However, the use of a single, monolithic foam block has been found to be impractical since large foam blocks are generally bulky and not amenable to inclusion in a comfortable swimsuit.

Flotation swimsuits using multiple smaller foam blocks have been developed which are less bulky and obtrusive than suits using single foam blocks and have been found to be aesthetically more appealing. These suits typically include a number of smaller foam blocks distributed at strategic locations within the swimsuit to ensure proper flotation and to maximize the likelihood that the airways of the wearer will remain above the surface of the water. In some prior flotation swimsuits, the foam blocks have been inserted into open pockets, however, there is some danger that blocks may fall out of an open pocket, or be removed by a child. Accordingly, it is desirable to place the foam blocks in closed pockets to prevent their removal.

Prior designs for flotation swimsuits incorporating numerous foam blocks in closed pockets have required relatively complicated construction steps, particularly the pocket closing step. The complexity of the sewing is also increased because the pocket construction and closing steps must be performed to form a separate pocket for each individual foam block. Therefore, there is a need for a new flotation swimsuit which has the advantages of the flotation swimsuits which incorporate numerous foam blocks, yet which minimizes the complexity of the required sewing and construction steps.

Accordingly, it is an object of the present invention to provide a floatation swimsuit having simplified sewing while still simulating the structure of a suit having numerous individual floatation elements.

Furthermore, it is an object of the present invention to provide a floatation swimsuit which provides a properly balanced buoyancy to ensure that the wearer's head and breathing passages remain above the surface of the water but which allows for a feeling of natural flexibility to aid the wearer in to learn to swim.

It is yet another object of the present invention to provide a floatation swimsuit which may be easily donned and removed.

BRIEF SUMMARY

The above objectives are accomplished according to the present invention by providing a floatation swimsuit having a unitary contoured floatation element for providing strategically distributed buoyancy to a wearer and for simulating the structure of several individual floatation elements. The flotation swimsuit includes a form-fitting torso covering which includes a retaining pocket for enclosing the unitary flotation element. The unitary flotation element includes a backsheet formed from a layer of buoyant material having a thickness within a first predetermined range for providing general buoyancy to a wearer and having an inner surface for presentation toward the wearer and an outer surface for presentation away from the wearer. The unitary flotation element also includes a plurality of enhanced buoyancy regions integrally carried by the backsheet in fixed relative positions for providing enhanced buoyancy to strategically selected areas of the wearer's body. Each of the enhanced buoyancy regions is formed from a buoyant material having a thickness substantially greater than that of the backsheet and each enhanced buoyancy region extends outwardly from the outer surface of the backsheet.

The floatation element may include a distributed buoyant layer having strategically positioned thickened areas to provide balanced floatation and may optionally include a fastenable opening in the chest region to allow easier donning and removal of the suit.

BRIEF DESCRIPTION OF THE DRAWINGS

The construction and design to carry out the invention will hereinafter be described together with other features thereof. The invention will be more readily understood from a reading of the following specification and by reference to the accompanying drawings forming a part thereof, wherein an example of the invention is shown and wherein.

DETAILED DESCRIPTION OF PREFERRED EMBODIMENTS

Figure 4:
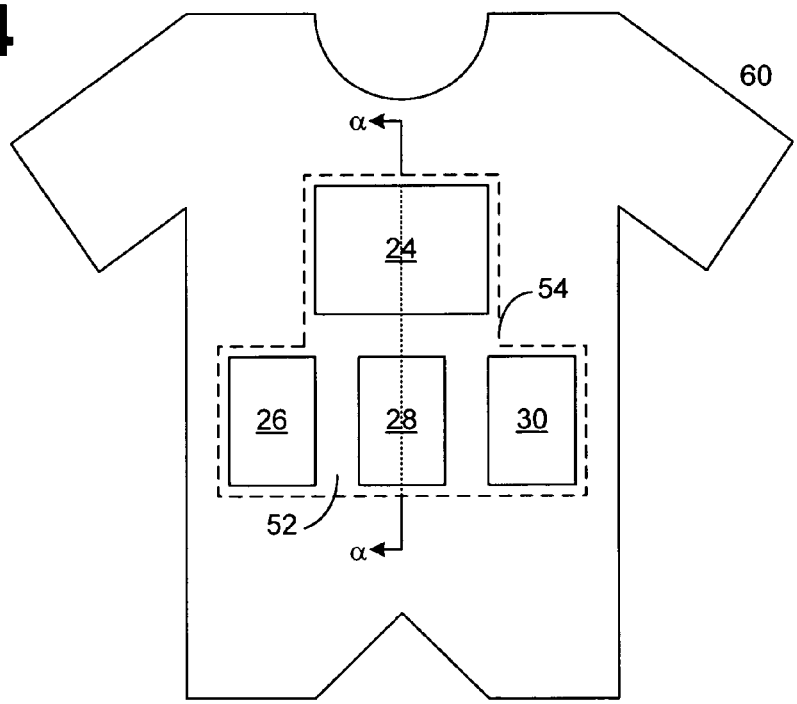
FIG. 4 illustrates a front view of a floatation swimsuit utilizing a unitary flotation element in accordance with the embodiment of FIG. 1.

Referring now in more detail to the drawings, the invention will now be described in detail. As shown in FIG. 4, in accordance with a preferred embodiment of the present invention, a flotation swimsuit A is provided. Flotation swimsuit A includes a form-fitting torso covering 60 having an element retaining pocket 54 for enclosing an unitary flotation element 20 depicted in FIG. 1. Unitary flotation element 20 includes a backsheet 22 from which protrude a plurality of enhanced buoyancy regions 24, 26, 28 and 30, for providing additional buoyancy to selected areas of flotation swimsuit A, thereby strategically controlling its buoyancy distribution. As shown in FIG. 4, in the preferred embodiment, enhanced buoyancy regions 24, 26, 28 and 30 are integral to unitary flotation element 20 which may be simply and easily attached to flotation swimsuit A by stitching as a single unit.

Figure 2:
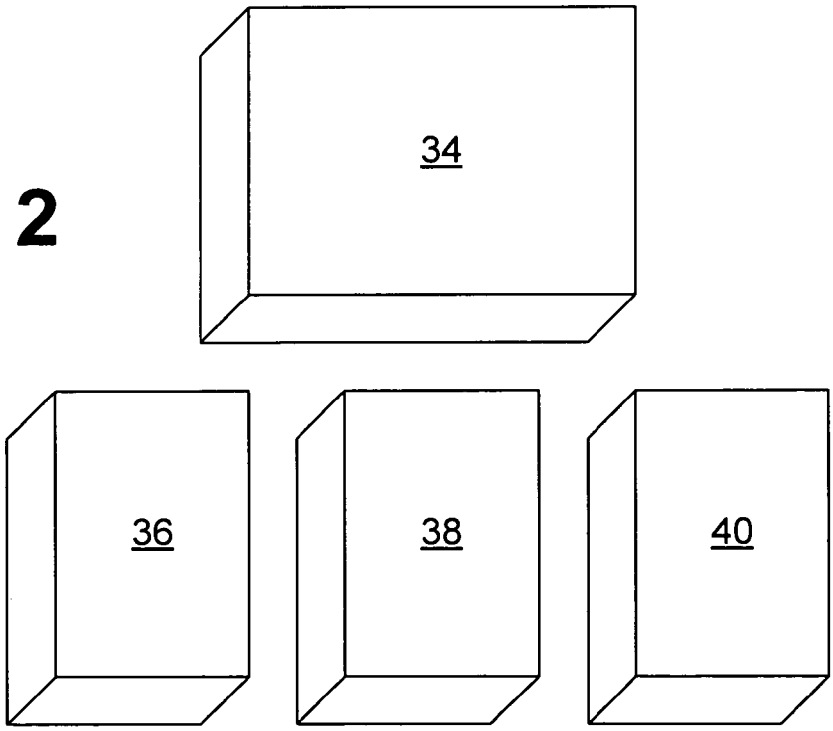
FIG. 2 Prior Art
FIG. 2 illustrates a front perspective view of a set of separate blocks of buoyant foam as are typically used in prior art flotation swimsuits.
Figure 3:
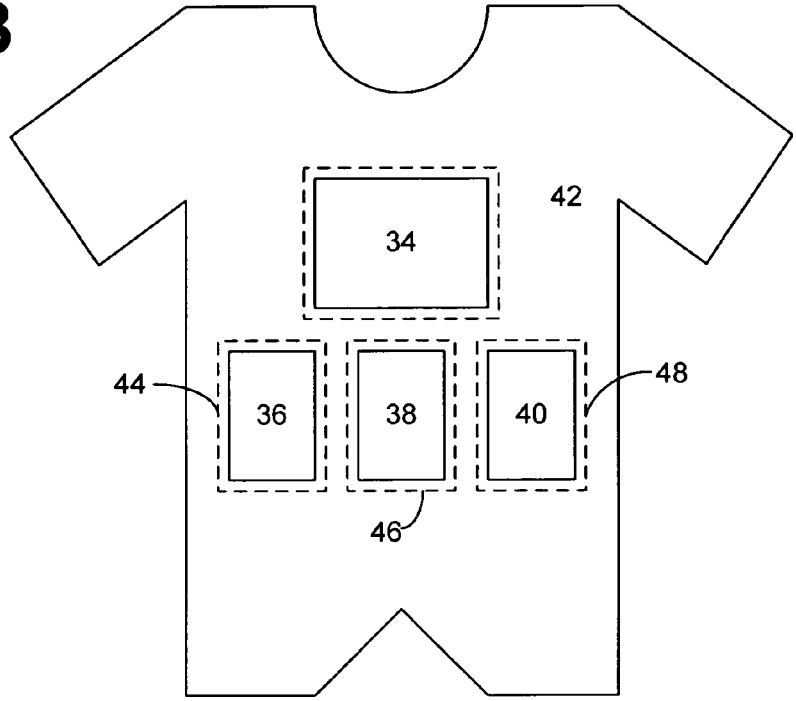
FIG. 3 Prior Art
FIG. 3 illustrates a front view of a prior art floatation swimsuit utilizing the separate blocks of buoyant foam of claim 2.

In contrast, FIG. 2 illustrates a front perspective view of a prior art set of separate foam elements 34, 36, 38 and 40 such as would typically be used to provide targeted buoyancy in a traditional flotation swimsuit B. As shown in FIG. 3, it is necessary to individually stitch each foam element 34, 36, 38 and 40 into its own respective element retaining pocket 42, 44, 46 and 48 to ensure that the elements remain at targeted locations. The shown configuration has the advantage of allowing targeted distribution of buoyancy to the upper and lower torso regions of the wearer and has been found to be aesthetically pleasing. However, the stitching required to form and close numerous element retaining pockets 42, 44, 46, and 48 adds greatly to the complexity and expense of the stitching and construction steps required to produce flotation swimsuits B incorporating multiple foam elements.

Figure 1:
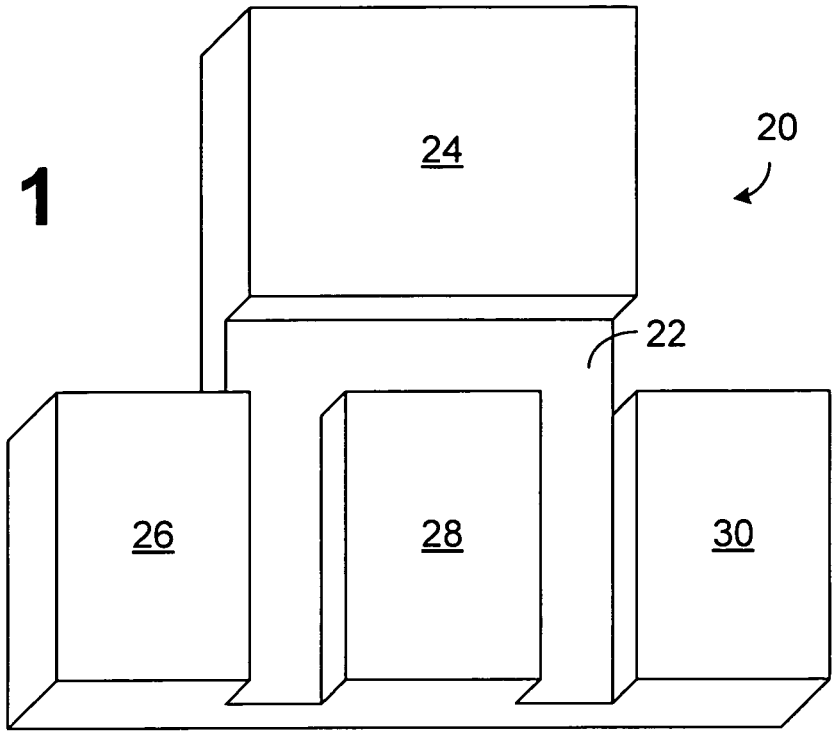
FIG. 1 illustrates a front perspective view of an unitary flotation element for use in a flotation swimsuit in accordance with a first embodiment of the present invention.

FIG. 4 illustrates a front view of a floatation swimsuit A utilizing the unitary flotation element 20 of FIG. 1. As can be seen, unitary flotation element 20 may attached to the form-fitting torso covering 60 of flotation swimsuit A utilizing a fabric sheet 52 which is stitched to form-fitting torso covering 60 of flotation swimsuit A to form an element retaining pocket 54 enclosing unitary flotation element 20. The stitching required to form element retaining pocket 54 and enclose unitary flotation element 20 is considerably less complex and expensive than the stitching that would be required to form the multiple element retaining pockets 42, 44, 46, and 48 used in a traditional flotation swimsuits such as swimsuit B shown in FIG. 3. Additionally, the unitary construction of flotation element 20 ensures that each of the enhanced buoyancy regions 24, 26, 28 and 30 remains at its targeted location, rather than moving about within unitary element retaining pocket 54, as would be the case if multiple individual foam elements 34, 36, 38 and 40 were placed into a single retaining pocket.

Figure 4B:
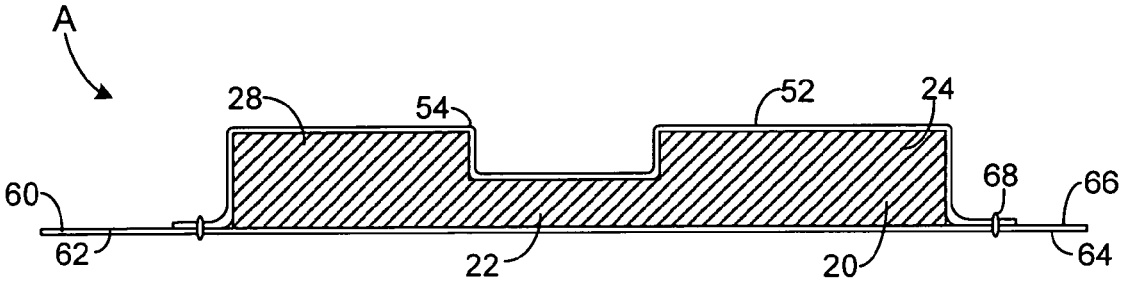
FIG. 4B illustrates a cross sectional view through a portion of the flotation swimsuit of FIG. 4 along cut line α-α.

FIG. 4B illustrates a cross sectional view through a portion of a flotation swimsuit A (taken along cut line α-α) incorporating a unitary flotation element 20 (shading indicates buoyant foam). A form-fitting torso covering 60 is provided which, in the preferred embodiment, is a variant of a simple one-piece swimsuit. Form-fitting torso covering 60 is constructed from a fabric sheet 62 defining an inner surface 64 for presentation toward a wearer and an outer surface 66 for presentation away from the wearer. In the preferred embodiment, fabric sheet 62 is a nylon/lycra fabric sheet, although other fabrics suitable for use in conventional swimsuits may also be acceptable. Unitary flotation element 20 is maintained adjacent the outer surface 66 of form-fitting torso covering 60 by fabric sheet 52 which is affixed to form-fitting torso covering 60 by stitching 68 to form unitary element retaining pocket 54. However, in alternative embodiments, fabric sheet 52 may be affixed to form-fitting torso covering 60 by a variety of other methods such as adhesives, lamination or rivets.

Unitary flotation element 20 includes a backsheet 22 having a first predetermined thickness and constructed from a buoyant material for providing general buoyancy to a wearer. A plurality of enhanced buoyancy regions 24 and 28 extend outwardly from the outwardly disposed surface of backsheet 22 at fixed relative positions for providing additional, strategically targeted buoyancy to specific areas of the wearer's body. In the preferred embodiment, buoyancy is targeted to the wearer's upper and lower torso regions to stabilize the wearer's flotation and to maximize the distance between the wearer's air passages and the surface of the water. Each enhanced buoyancy region 24 and 28 is constructed from a buoyant material and has a thickness in a second predetermined range which is substantially greater than the thickness of backsheet 22.

In the preferred embodiment, unitary flotation element 20 is constructed from a single piece of buoyant material which encompasses both backsheet 22 and enhanced buoyancy regions 24, 26, 28 and 20 as illustrated in FIG. 1. For example and not limitation, unitary flotation element 20 may molded from a closed-cell foamed plastic which is of a thermoformable grade, such as a foam from the polyolefin family of materials. The foamed plastic should be relatively lightweight, having a density of no more that 4 pcf (pounds per cubic foot). In the preferred embodiment, floatation element 20 is a cross-linked polyethylene foam material having a density of approximately 2 pcf, such as is used in some other personal flotation devices. Alternatively, an expanded polypropylene foam having a similar density could also be used. A second unitary flotation element having a similar structure may also be included for attachment to the rear of form-fitting torso covering 60 as necessary to provide an appropriate buoyancy distribution to keep a wearer's head above the surface of a body of water.

In the preferred embodiment, fabric sheet 52 is laminated to the outwardly disposed surface of unitary flotation element 20, thereby ensuring that fabric sheet 52 closely follows the contour of unitary flotation element 20. The periphery of fabric sheet 52 may then be sewn to torso covering 60 to form an element retaining pocket 54. Laminating fabric sheet 52 to unitary flotation element 20 ensures that no shifting of unitary flotation element 20 occurs within element retaining pocket 54. Additionally, laminating fabric sheet 52 to unitary flotation element 20 also results in a finished flotation swimsuit A which simulates the aesthetically desirable contoured look which would be obtained by attaching multiple foam elements in a traditional flotation swimsuit B as shown in FIG. 3.

In the preferred embodiment unitary floatation element 20 will be formed as follows. The foam material is cut to a suitable pre-molding size, called a blocker, and heated in a conveyorized, computer-controlled oven. Once the blocker is heated to a pre-designated temperature throughout, the blocker is removed from the oven conveyor and placed between two machined aluminum mold halves attached to the platens of a hydraulic or air-cylinder operated press.

The press is operated, closing the mold halves around the heated blocker, forcing the foam into the desired shape, and holding it there while the material is cooled to a temperature sufficiently cool enough to allow it to maintain the desired shape. The molded blocker, containing one or more of the desired flotation elements 20 is then removed from the molds and any necessary trimming of unwanted flashing is done.

The fabric material may be laminated to the foamed plastic in either a one-step or a two-step process. In the one-step process, two fabric layers are utilized, one for the top of the foam and one for the bottom of the foam. Both of the layers are pre-coated on one side with a heat-activated adhesive, and are placed on the top or the bottom, respectively, of the foam blocker during the foam heating process. When this sandwich construction is placed into the mold halves the fabric is affixed to the foam through a combination of heat and pressure. By virtue of the fabric's inherent stretch, the fabric conforms to the shape the foam is being forced into during the molding process. This molded composite may then be removed from the molds as described above, and any necessary trimming of unwanted flashing is done. If desired, a specific amount of flashing may be left, which will be a combination of fabric/foam/fabric in which the foam has been compressed to as minimal thickness, thereby facilitating subsequent sewing operations necessary to complete the flotation suit.

In the two-step method, the fabric is affixed to the molded foam component in a secondary operation. In this secondary operation, a pre-molded foam component is placed between two machined aluminum mold halves that are heated, with the two pieces of fabric, with their pre-coating of heat-activated adhesive, being placed on the top and the bottom of the foam. The press is operated, laminating the fabric to the foam as it is being stretched to follow the contours of the pre-molded foam. The two-step method could be employed to allow the fabric to extend beyond the dimensions of the pre-molded and already trimmed foam part in order to eliminate any foam in the sewable area, thus making the sewing operations easier to perform.

Different mold sets may be used to produce the range of product sizes required for proper flotation properties over a range of user weights. The size range may be produced by having flotation components manufactured with a range of different overall length and width dimensions, or a range of different overall thicknesses, or a combination of the two. In the event that a different thickness is necessary for two or more components having the same dimensional "footprint", a sizer collar or collars may be incorporated into the mold set to minimize both the number of mold sets necessary and the total cost of the mold sets.

Figure 12B:
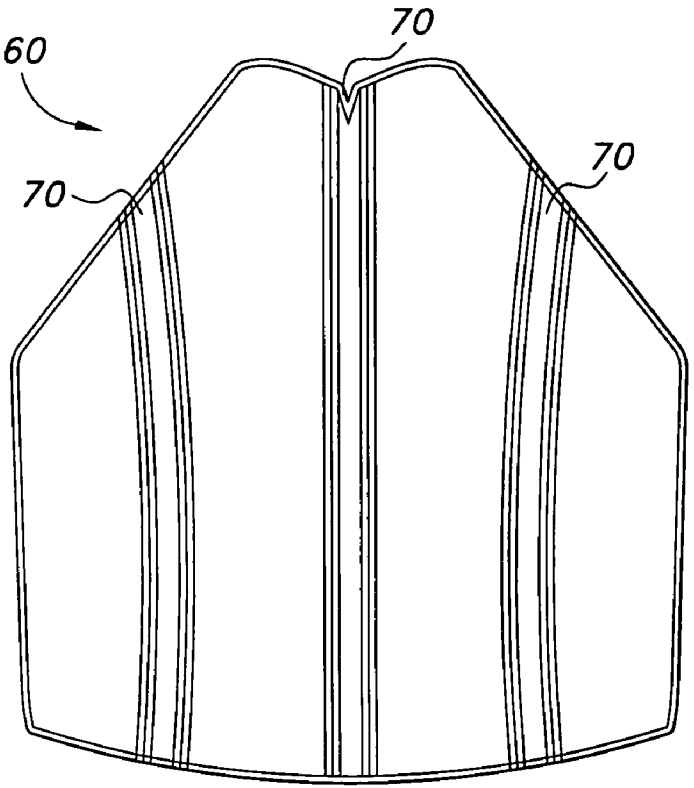
FIGS. 12A and 12B illustrate front and rear views, respectively, of a single front flotation element in accordance with a preferred embodiment of the present invention.
Figure 12A:
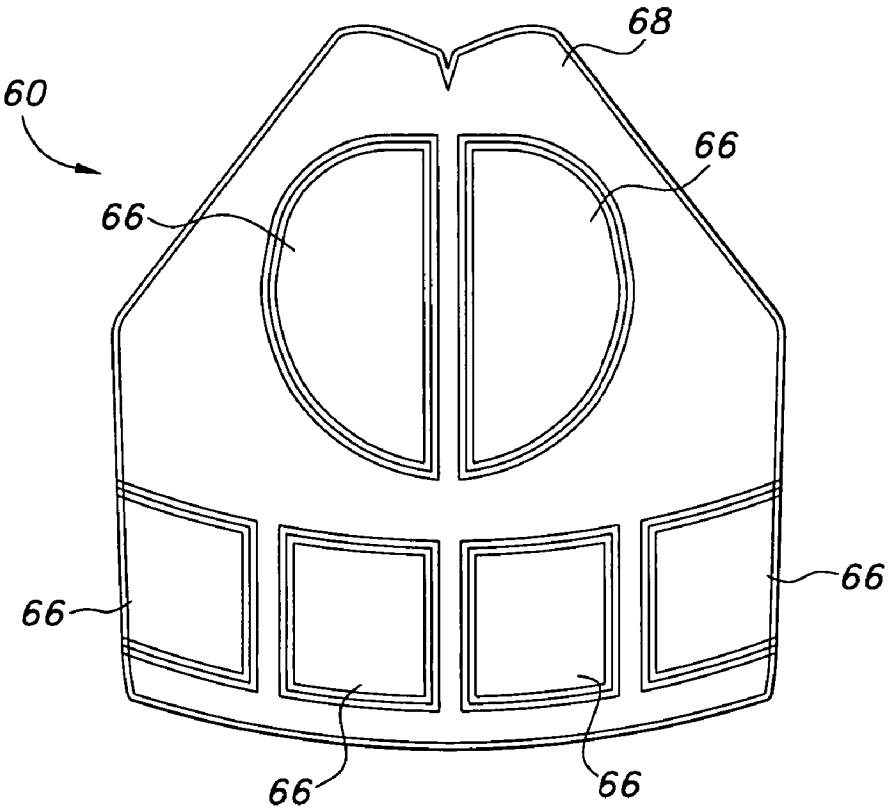
Figure 13B:
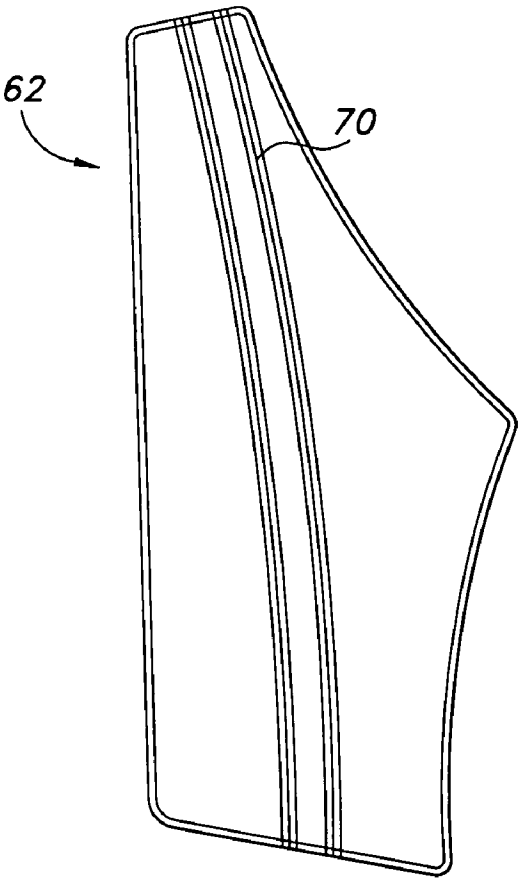
FIGS. 13A and 13B illustrate front and rear views, respectively, of a rear flotation element in accordance with a preferred embodiment of the present invention.
Figure 13A:
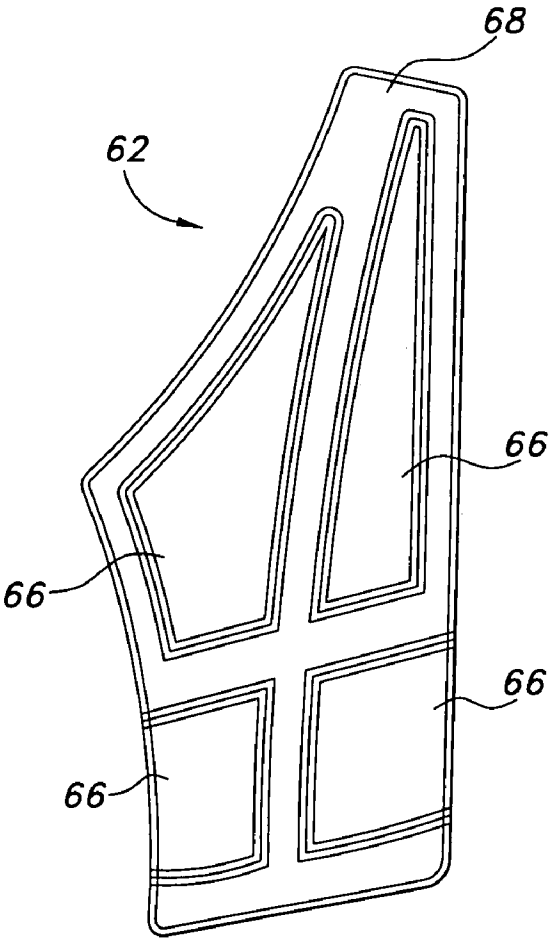

FIGS. 12A and B and 13A and B illustrate a front and rear views of a presently preferred configuration of flotation elements for use in a flotation swimsuit A. A single front flotation element 60, illustrated in FIGS. 12A and 12B, is provided for providing balanced buoyancy in conjunction with a pair of rear flotation elements 62, one of which is illustrated in FIGS. 13A and 13B. Two rear flotation elements 62, are utilized to allow placement of a fastenable opening in the center of the back of the flotation swimsuit A to facilitate the donning and removal of the suit by a wearer. Each of front and rear flotation elements 60 and 62 include a plurality of enhanced buoyancy regions 66 disposed atop a backsheet 68. Additionally, each back sheet 68 includes a plurality of inwardly disposed flexion channels 70 for allowing the flotation element 60 or 62 to flex to fit the form of the wearer. Flexion channels 70 increase the flexibility of the flotation swimsuit A, and in conjunction with a properly balanced buoyancy distribution can assist a wearer in learning to swim without creating a feeling of unnatural stiffness or buoyancy upon which the wearer may become dependent.

The front and rear floatation elements shown respectively in FIGS. 12 and 13 represent a configuration providing approximately 12 pounds of buoyancy. The cubic volume of the components represented by these drawings is 350 $in^3$. Other sizes will have proportional increases or decreases in the buoyancy provided by virtue of the proportional increases or decreases in their cubic volume. As mentioned earlier, these changes in cubic volume may be made by increasing or decreasing the "footprint" of the part, or by increasing or decreasing the thickness of the part, or by a combination of both of these methods. For instance, flotation components having a total flotation specification of 9 pounds of buoyancy would require 75% of the cubic volume necessary to provide 12 pounds of buoyancy. The design of this 9 pound part would be done incorporating this absolute cubic volume value. Other desired bouyancies can be achieved by similarly varying the dimensions of the flotation elements.

In order to provide a higher level of safety to the wearer and to comply with state and federal safety regulations, it is desirable to provide an indicator of the wear and degradation which may occur to the fabric components of form-fitting torso covering 60 and element retention pockets 54 upon use and exposure to the elements. Accordingly, in the preferred embodiment, fabric components, form-fitting torso covering 60 and element retention pockets 54 include a dye which may be slowly bleached upon exposure to chlorinated water and/or sunlight, providing an indication to the wearer that the fabric materials of the swimsuit are likewise beginning to degrade.

Figure 5:
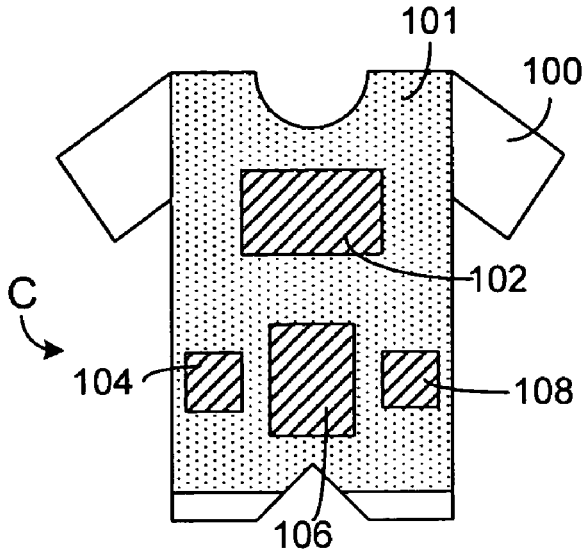
FIG. 5 illustrates a front view of a sleeved floatation swimsuit having a whole body flotation member including enhanced buoyancy regions in accordance with a second embodiment of the present invention.
Figure 6:
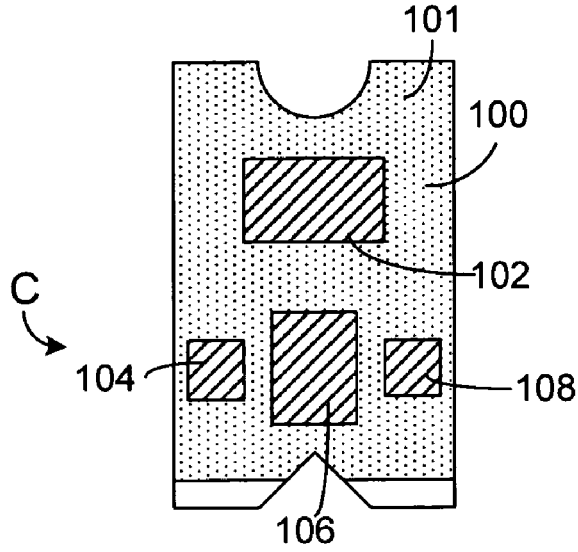
FIG. 6 illustrates a front view of a sleeveless floatation swimsuit having a whole body flotation member including enhanced buoyancy regions in accordance with a second embodiment of the present invention.

FIG. 5 and FIG. 6, respectively, illustrate front views of sleeved and sleeveless floatation swimsuits C having a distributed flotation layer and including enhanced buoyancy regions in fixed relative positions in accordance with a second embodiment of the present invention. In the embodiment of FIG. 5 and FIG. 6, a form-fitting torso covering 100 is provided, which includes a distributed layer of buoyant material 101 (indicated by speckling) distributed throughout a substantial portion thereof. Enhanced buoyancy regions 102, 104, 106 and 108 (indicated by shading) are provided at selected fixed sites upon the surface of form-fitting torso covering 100 to provide strategically distributed buoyancy to the wearer. Use of a distributed layer of buoyant material throughout a substantial portion of form-fitting torso covering 100 reduces the necessary thickness of enhanced buoyancy regions 102, 104, 106 and 108, producing a more comfortable and sleeker appearing flotation swimsuit C than would be possible if the buoyancy were limited solely to enhanced buoyancy regions 102, 104, 106 and 108.

Form-fitting torso covering 100 is preferably constructed from a flexible, high-strength, buoyant material such as the closed-cell neoprene commonly used in the construction of wet suits for swimmers and divers. In an alternative embodiment, form-fitting torso covering 100 and any associated sleeves may include one or more layers of fabric laminated or otherwise attached to the buoyant material. In either case, it may also be preferable to include a component which is opaque to ultraviolet radiation in the construction of form-fitting torso covering 100 to provide a wearer with protection from harmful solar radiation.

Enhanced buoyancy regions 102, 104, 106 and 108 are preferably integrally molded to protrude from the outer surface of form-fitting torso covering 100. However, one of ordinary skill in the art will recognize that enhanced buoyancy regions 102, 104, 106, and 108 may also be attached to the outer surface of form-fitting torso covering by stitching or may be enclosed within element retaining pockets similar to those discussed with regard to the embodiment of FIGS. 1 and 4. In either case, enhanced buoyancy regions 102, 104, 106 and 108 should has a thickness substantially greater than that of form-fitting torso covering 100. In embodiments wherein enhanced buoyancy regions 102, 104, 106 and 108 are not integral to form-fitting torso covering 100, they are preferably constructed of a material having a greater buoyancy and less flexibility than the material of which form-fitting torso covering 100 is composed.

Figure 7A:
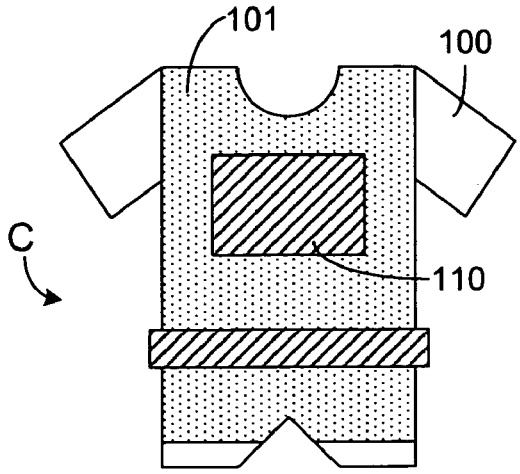
FIGS. 7A-C illustrate front views of flotation swimsuits having a variety of upper torso enhanced buoyancy regions for use in accordance with variations of the embodiments of FIGS. 5 and 6.
Figure 7B:
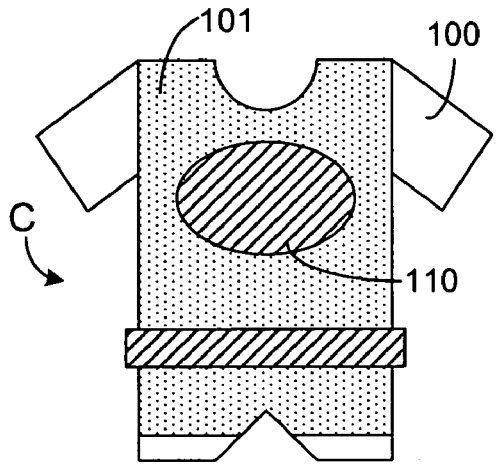
Figure 7C:
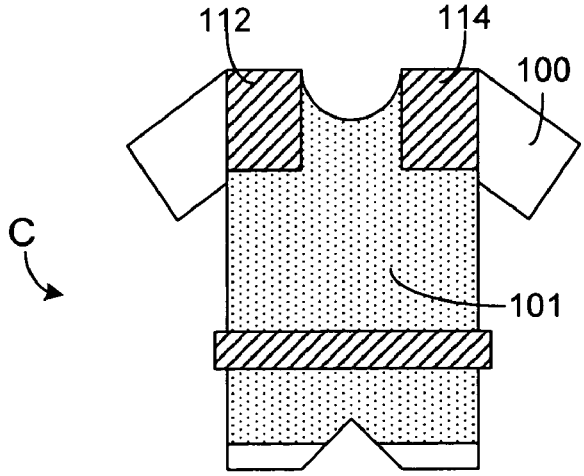

In the preferred embodiment of the present invention, a large upper torso enhanced buoyancy region 110 is provided to provide significant buoyancy to help keep the wearer's breathing passages above the surface of the water when the wearer is swimming or floating. FIGS. 7A-C illustrate front perspective views of a variety of upper torso enhanced buoyancy regions for use in accordance with variations of the embodiment of FIGS. 5 and 6. Upper torso enhanced buoyancy region 110 may be rectangular as shown in FIG. 7A, ovoid as shown in FIG. 7B, or any of a variety of other shapes as long as the center of buoyancy is conducive to maintaining the wearer's breathing passages above the surface of the water. Also, as illustrated in FIG. 7C, the upper torso enhanced buoyancy 110 region may also include a plurality of smaller enhanced buoyancy regions 112 and 114 disposed to provide buoyancy to selected regions of the upper torso of the wearer, such as the shoulder regions.

Figure 8A:
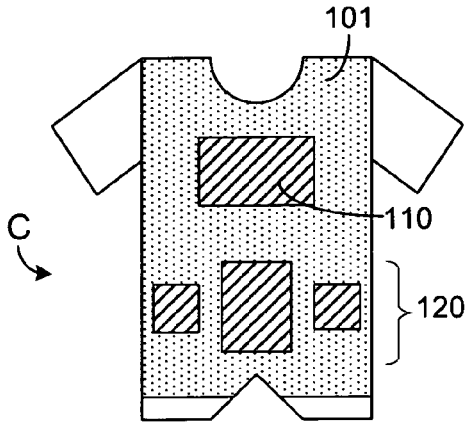
FIGS. 8A-G illustrate front views of a flotation swimsuits having a variety of lower torso enhanced buoyancy regions for use in accordance with variations of the embodiments of FIGS. 5 and 6.
Figure 8B:
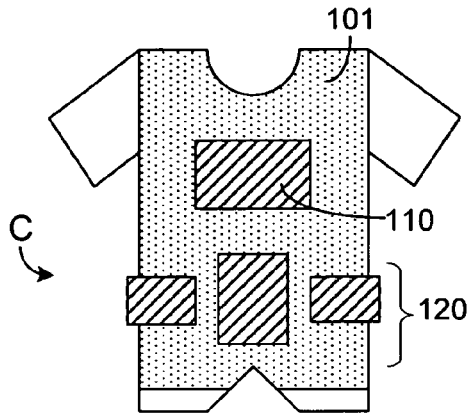
Figure 8C:
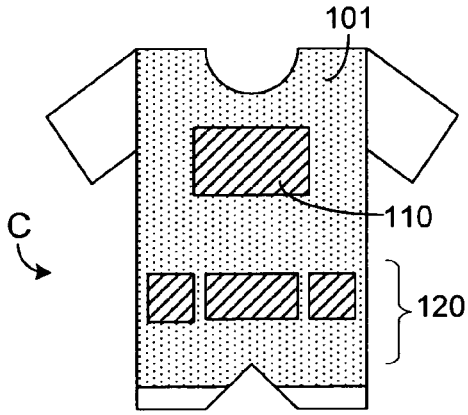
Figure 8D:
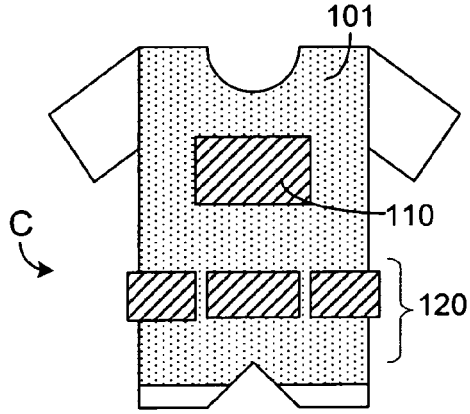
Figure 8E:
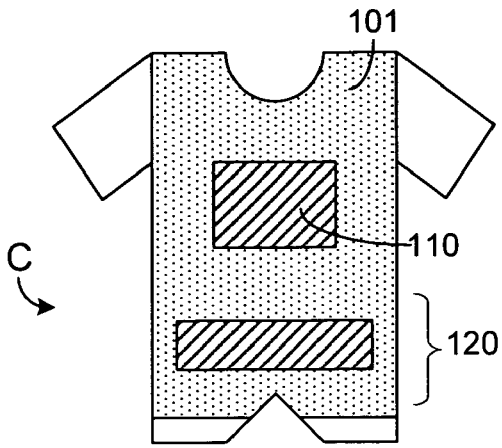
Figure 8F:
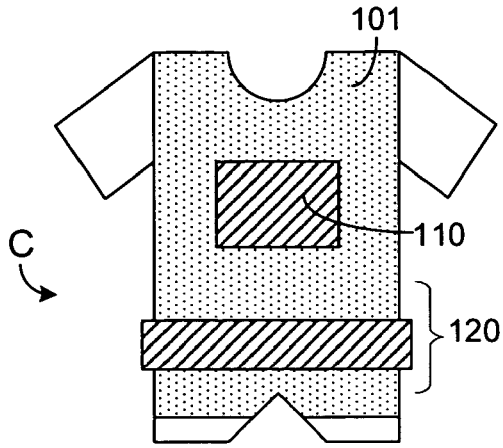
Figure 8G:
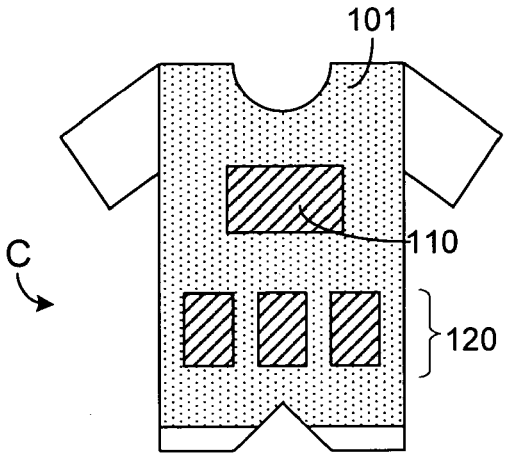

In the preferred embodiment, flotation swimsuit C also includes a lower torso enhanced buoyancy region 120 for providing additional buoyancy to the wearer. FIGS. 8A-G illustrate front perspective views of a variety of lower torso enhanced buoyancy regions 120 for use in accordance with variations of the embodiment of FIGS. 5 and 6. As can be seen, the lower torso enhanced buoyancy regions 120 may come in a wide variety of configurations including circumferentially distributed blocks (FIGS. 8A through 8D and 8G) or a single circumferential band (FIGS. 8E and 8F)

Figure 9:
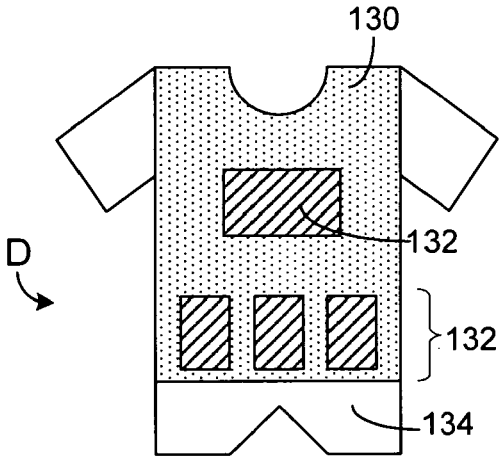
FIG. 9 illustrates a front view of a floatation swimsuit having a upper torso distributed buoyancy layer and including enhanced buoyancy regions in accordance with a yet another embodiment of the present invention.

FIG. 9 illustrates a front view of a floatation swimsuit D having an upper torso distributed buoyancy region 130, and including several enhanced buoyancy regions 132 in accordance with a yet another embodiment of the present invention. In the embodiment of FIG. 9, distributed buoyancy region 130 is limited to the upper region of the torso of the wearer, and is not present at the lower torso and leg regions 134. Concentration of buoyancy in the upper torso region should also help to maintain the wearers air passages above the surface of the water in circumstances.

Figure 10A:
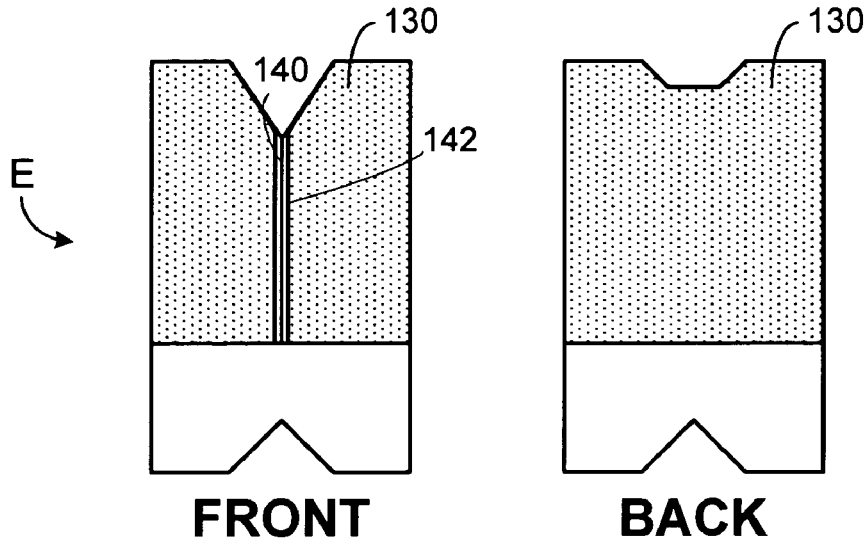
FIGS. 10A and 10B illustrate front views of flotation swimsuits having fastenable chest openings in accordance with yet another embodiment of the present invention.
Figure 10B:
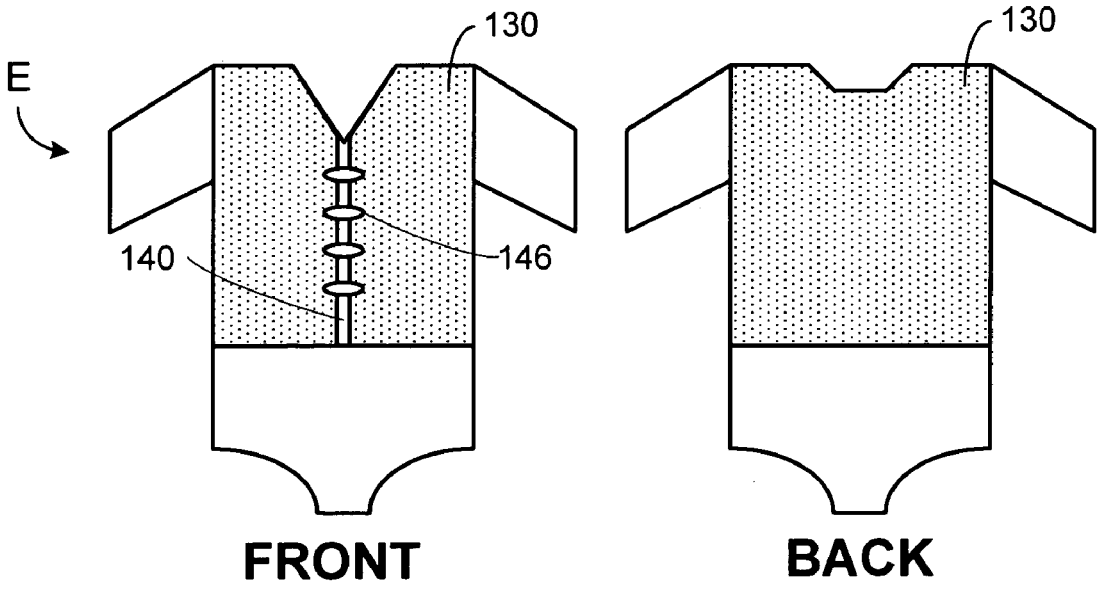

In yet another embodiment, it is preferable to provide a fastenable torso opening 140 to allow easier donning and removal of a flotation swimsuit E. FIGS. 10A and 10B illustrate front perspective views of flotation swimsuits having a fastenable chest openings 140. As shown in FIG. 10A, chest opening 140 may be fastened using a full length closure mechanism 142 such as a zipper or hook and loop fastener 144. Alternatively, as shown in FIG. 10B, chest opening 140 may be fastened using a periodically spaced closure mechanism 146 such as ties, hooks, snaps, buttons, clasps, or adjustable straps with quick connect clasps.

Figure 11B:
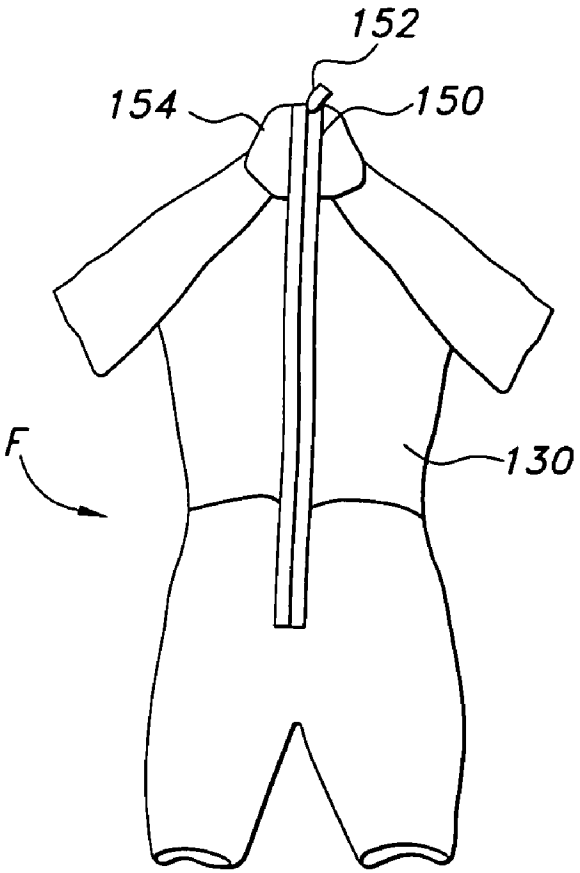
FIG. 11 illustrate front and rear views, respectively, of a flotation swimsuit having a fastenable back opening in accordance with yet another embodiment of the present invention.
Figure 11A:
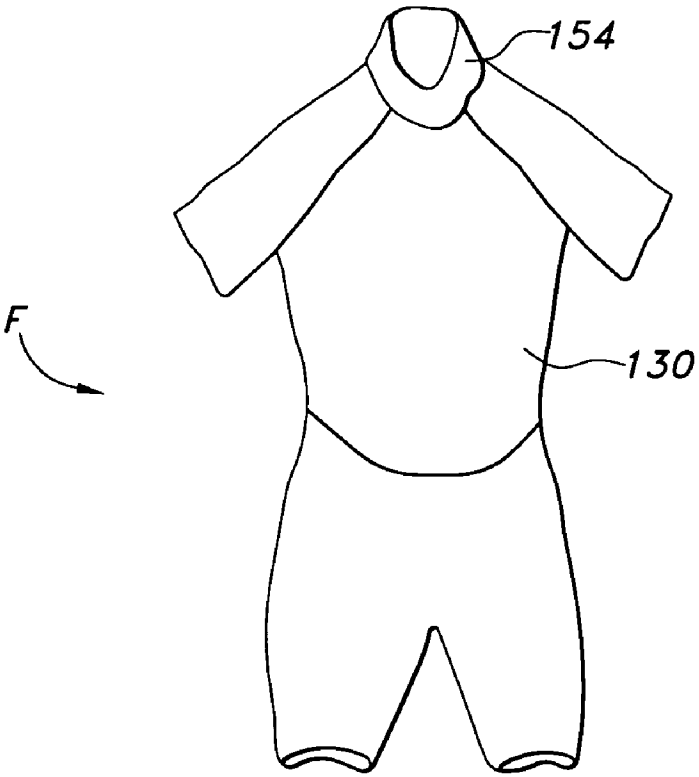

FIGS. 11A and 11B illustrate a front and rear views, respectively, of a flotation swimsuit F having a distributed buoyancy region 130 (indicated by shading) and a fastenable back opening 150 in accordance with yet another embodiment of the present invention. As shown in FIG. 11B, it may be preferable to have a fastenable torso opening 150 in the rear of a flotation swimsuit F in order to help prevent removal by toddlers and small children. By placing the fastenable opening 150 in the rear of the flotation swimsuit F it is possible to make it difficult, if not impossible for a child or toddler to remove the flotation swimsuit without assistance, thereby ensuring that the child or toddler cannot remove the flotation swimsuit F. As in the embodiments of FIGS. 10A and 10B, the fastenable closure mechanism 150 may include a full length closure mechanism 152 such as a zipper or hook and loop fastener. Alternatively, rear fastenable opening 150 may be fastened using a periodically spaced closure mechanism such as a set of ties, hooks, snaps, buttons, clasps, straps, or adjustable straps having quick connect clasps.

Also as shown in FIGS. 11A and 11B, in some embodiments it may be desirable to include a buoyant collar 154 to provide additional buoyancy beyond that provided by distributed buoyancy region 130. The use of a buoyant collar 154 also may be used to ensure that the head of a very small child or unconscious wearer is kept above the surface of the water.

In any of the above discussed embodiments, it is desirable to tailor the amount of total buoyancy and the distribution of buoyancy to the values appropriate for the children or other individuals who will actually be wearing the flotation swimsuits. The Coast Guard has set minimum buoyancy values for personal flotation devices which correspond to the relative weights of the child wearers. For example, a minimum of 4.5-7.0 pounds of buoyancy is mandated for infants and small children weighing between thirty and forty pounds and a minimum of 11.0 pounds of buoyancy is required for children weighing between fifty and ninety pounds. For larger children and adults, the maximum buoyancy likely to be necessary is approximately 19.0-20.0 pounds. The Coast Guard regulations also mandate that no less than 50% of the required minimum buoyancy be distributed to front portion of the wearer in order to ensure a proper relative balancing of the wearer to maximize the distance between the wearers breathing passages and the surface of the water when the wearer is floating freely.

It thus will be appreciated that the objects of this invention have been fully and effectively accomplished. It will be realized, however, that the foregoing exemplary embodiments have been shown and described for the purpose of this invention and are subject to change without departure from such principles. Therefore, this invention includes all modifications encompassed within the spirit and scope of the following claims.

I claim:

1. In a child flotation swimsuit comprising a child flotation device having strategically targeted buoyancy to provide a natural feeling of buoyancy, the child flotation device comprising:

a layer of buoyant material having a first thickness to provide general buoyancy;

a plurality of enhanced buoyancy regions integrated with the layer of buoyant material to provide enhanced buoyancy relative to the general buoyancy provided by the buoyant material;

wherein the enhanced buoyancy regions comprise a buoyant material having a thickness greater than the first thickness and that extends outwardly from the first layer of buoyant material such that the buoyant material layer and enhanced buoyancy regions define a contour profile; and the thickness of at least one of the enhanced buoyancy regions being reduced based on a substantially uniform thickness associated with the buoyant material such that the contour profile has a sleek appearance.

2. The child flotation device of claim 1, wherein one of the enhanced buoyancy regions is disposed within an upper torso region defined by the buoyant material layer to provide enhanced buoyancy at the upper torso region relative to the general buoyancy provided by the buoyant material.

3. The child flotation device of claim 2, wherein one of the enhanced buoyancy regions is disposed within a lower torso region defined by the buoyant material layer to provide enhanced buoyancy at the lower torso region relative to the general buoyancy provided by buoyant material.

4. The child flotation device of claim 3, further comprising at least one flexion channel disposed between at least two enhanced buoyancy regions and defined by the buoyant material layer, wherein the at least one flexion channel has a thickness less than the first thickness and permits the buoyant material layer to flex such that the at least two enhanced buoyancy regions flex relative to the at least one flexion channel.

5. The child flotation device of claim 1, further comprising a fabric sheet disposed on the contour profile to secure the enhanced buoyancy regions and the buoyant material from shifting such that the enhanced buoyancy regions remain proximate an associated targeted buoyancy location.

6. The child flotation device of claim 5, wherein a fabric sheet is laminated on the enhanced buoyancy regions.

7. The child flotation device of claim 1, further comprising a torso cover adapted to be worn by a child, wherein a fabric sheet is attached to the torso cover such that the buoyant material layer and enhanced buoyancy regions are disposed between the torso cover and the fabric sheet such that the buoyant material layer and enhanced buoyancy regions are prevented from shifting relative to the torso cover.

8. A child flotation swimsuit comprising a strategically controlled buoyancy distribution to provide a stable and natural buoyancy for a child, the flotation swimsuit comprising:

a front flotation element to provide general buoyancy to a child's front torso;

a first rear flotation element and a second rear flotation element to provide general buoyancy to a child's rear torso, wherein the front flotation element and the first and second rear flotation elements provide a balanced buoyancy distribution to a child;

a first set of enhanced buoyancy regions carried by the front flotation element, the first set of enhanced buoyancy regions being disposed on the front flotation element at targeted locations to provide a controlled buoyancy distribution;

a second set of enhanced buoyancy regions carried by the first and second rear flotation element, the second set of enhanced buoyancy regions being disposed on the first and second rear flotation elements at targeted locations to provide a controlled buoyancy distribution;

a plurality of inwardly disposed flexion channels, wherein at least one of the flexion channels is disposed on an inner surface of the front flotation element, the first rear flotation element, and the second rear flotation element thereby enabling the flotation elements to flex about an axis defined by the flexion channels; and wherein the thickness of at least one of the enhanced buoyancy regions is reduced based on a substantially uniform thickness of the front, first rear, and second rear flotation element.

9. The flotation swimsuit of claim 8 further comprising a plurality of fabric sheets and a torso covering, wherein one of the plurality of fabric sheets is laminated to the front, first rear, and second rear flotation elements and the fabric sheets are attached to the torso covering such that the laminated fabric sheet prevents the front, first rear, and second rear flotation elements from shifting relative to the torso covering.

10. The flotation swimsuit of claim 9, wherein at least one of the fabric sheets has a periphery that extends beyond a corresponding one of the front, first rear, or second rear flotation elements such that corresponding flotation element does not does not extend into an area where the fabric sheets are attached to the torso covering.

11. The flotation swimsuit of claim 8, the front flotation element comprising an upper torso region and a lower torso regions and wherein the first set of enhanced buoyancy regions are located within the upper and lower torso regions to provide targeted buoyancy to the upper and lower torso regions.

12. The flotation swimsuit of claim 8, wherein the contour profile associated with the front, first rear, and second rear flotation elements has a sleek appearance.

13. The flotation swimsuit of claim 12, wherein a cover fabric is laminated to the flexible flotation element.

14. A child flotation swimsuit to provide natural buoyancy to a child when using the flotation swimsuit in a body of water, the flotation swimsuit comprising:

a flexible flotation element having a substantially uniform thickness, defining an inner and outer substantially planar surface, defining an upper torso area corresponding to a child's upper torso region, defining a lower torso region corresponding to a child's lower torso region, and having a general buoyancy;

a plurality of enhanced buoyant regions having a thickness greater than the substantially uniform thickness to provide a buoyancy greater than the general buoyancy and extending from the outer substantially planar surface, wherein the enhanced buoyant regions define a contour profile; and wherein the thickness of at least one of the enhanced buoyancy regions is reduced in part due to the substantially uniform thickness of the flexible flotation element such that the contour profile has a sleek appearance.

15. The flotation swimsuit of claim 14, further comprising a plurality of inwardly disposed flexion channels disposed on the inner substantially planar surface of the flexible flotation element, wherein the flexion channels enable the flexible flotation element to flex about an axis defined by the flexion channels thereby preventing a user from becoming dependent on the flotation swimsuit.

16. The flotation swimsuit of claim 14, further comprising a torso covering, wherein a cover fabric is coupled to the torso covering to define a retaining pocket to hold the flexible flotation element such that the retaining pocket prevents the flexible flotation element from shifting relative to the torso covering.

17. The flotation swimsuit of claim 16, wherein the fabric cover extends beyond flotation element so that flotation element does not extend into an area where the fabric cover is coupled to the torso covering.

18. The flotation swimsuit of claim 11, further comprising a second flotation element and a third flotation element, each defining an upper portion and lower portion, having a substantially uniform thickness, and having a plurality of enhanced buoyancy regions having a thickness greater than the substantially uniform thickness, wherein the enhanced buoyancy regions provide targeted enhanced buoyancy to the upper portion and lower portion.

19. The flotation swimsuit of claim 18, further comprising a second fabric cover associated with the second flotation element and a third fabric cover sheet associated with the third flotation element, wherein the second and third fabric covers cover at least one of the enhanced buoyancy regions to prevent the enhanced buoyancy regions from shifting such that the enhanced buoyancy regions remain within the upper and lower portions.

* * * * *